US008867751B2

(12) United States Patent
Kim

(10) Patent No.: US 8,867,751 B2
(45) Date of Patent: Oct. 21, 2014

(54) METHOD, MEDIUM, AND SYSTEM ENCODING/DECODING A MULTI-CHANNEL AUDIO SIGNAL, AND METHOD MEDIUM, AND SYSTEM DECODING A DOWN-MIXED SIGNAL TO A 2-CHANNEL SIGNAL

(75) Inventor: Youngtae Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1660 days.

(21) Appl. No.: 11/702,077

(22) Filed: Feb. 5, 2007

(65) Prior Publication Data

US 2008/0037809 A1 Feb. 14, 2008

(30) Foreign Application Priority Data

Aug. 9, 2006 (KR) ..... 10-2006-0075390

(51) Int. Cl.

| | |
|---|---|
| ***H04R 5/00*** | (2006.01) |
| ***H04R 5/02*** | (2006.01) |
| ***G10L 19/008*** | (2013.01) |
| ***H04S 3/00*** | (2006.01) |

(52) U.S. Cl.

CPC ..... *H04S 3/008* (2013.01); *H04S 2400/01* (2013.01); *H04S 2420/03* (2013.01); *G10L 19/008* (2013.01); *H04S 2420/01* (2013.01)

USPC ..... 381/22; 381/23; 381/310

(58) Field of Classification Search

USPC ..... 381/1–2, 10–12, 17–23, 300–311; 700/94; 704/500, E19.005

See application file for complete search history.

(56) References Cited

U.S. PATENT DOCUMENTS

| | | | | |
|---|---|---|---|---|
| 5,870,480 | A * | 2/1999 | Griesinger | 381/18 |
| 6,205,430 | B1 | 3/2001 | Hui | |
| 6,470,087 | B1 | 10/2002 | Heo et al. | |

(Continued)

FOREIGN PATENT DOCUMENTS

| | | |
|---|---|---|
| EP | 1533928 | 5/2005 |
| JP | 2005-352396 | 12/2005 |

(Continued)

OTHER PUBLICATIONS

Notice of Allowance in Korean Patent Application No. 10-2006-0075390 dated Mar. 26, 2008.

(Continued)

*Primary Examiner* — Xu Mei

(74) *Attorney, Agent, or Firm* — Staas & Halsey LLP

(57) ABSTRACT

A method, medium, and system encoding and/or decoding a multi-channel audio signal, and a method, medium, and system decoding a signal down-mixed from multi-channels to a 2-channel signal. The method of encoding an audio signal may include generating spatial cues indicating directivity information of a virtual sound source generated by at least two channel sound sources among a plurality of channels, and down-mixing the plurality of channel signals. The method of decoding an audio signal may include receiving inputs of spatial cues indicating directivity information of a virtual sound source generated by at least two channel sound sources among sound sources of a plurality of channels, and a signal down-mixed from the plurality of channel signals, and restoring the down-mixed signal to a plurality of channel signals by using the spatial cues. According to such systems, media, and methods, a multi-channel audio signal can be accurately encoded and/or decoded regardless of frequency bands.

25 Claims, 9 Drawing Sheets

(56) References Cited

U.S. PATENT DOCUMENTS

| | | | | |
|---|---|---|---|---|
| 6,628,787 | B1 | 9/2003 | McGrath et al. | |
| 6,934,395 | B2 * | 8/2005 | Ito | 381/23 |
| 7,096,080 | B2 * | 8/2006 | Asada et al. | 700/94 |
| 7,110,550 | B2 * | 9/2006 | Motojima et al. | 381/27 |
| 7,606,373 | B2 * | 10/2009 | Moorer | 381/18 |
| 7,783,495 | B2 | 8/2010 | Seo et al. | |
| 2005/0273324 | A1 * | 12/2005 | Yi | 704/226 |
| 2008/0025519 | A1 * | 1/2008 | Yu et al. | 381/17 |
| 2008/0052089 | A1 | 2/2008 | Takagi | |

FOREIGN PATENT DOCUMENTS

| | | |
|---|---|---|
| KR | 10-0206333 | 4/1999 |
| KR | 10-2005-0060552 | 6/2005 |
| KR | 10-2006-0049941 | 5/2006 |
| KR | 10-0663729 | 12/2006 |

OTHER PUBLICATIONS

International Search Report and Written Opinion dated Sep. 28, 2007 in International Application No. PCT/KR2007/003162.

* cited by examiner

METHOD, MEDIUM, AND SYSTEM ENCODING/DECODING A MULTI-CHANNEL AUDIO SIGNAL, AND METHOD MEDIUM, AND SYSTEM DECODING A DOWN-MIXED SIGNAL TO A 2-CHANNEL SIGNAL

CROSS-REFERENCE TO RELATED APPLICATIONS

This application claims the benefit of Korean Patent Application No. 10-2006-0075390, filed on Aug. 9, 2006, in the Korean Intellectual Property Office, the disclosure of which is incorporated herein in its entirety by reference.

BACKGROUND OF THE INVENTION

1. Field of the Invention

One or more embodiments of the present invention relate to a method, medium, and system encoding and/or decoding a multi-channel audio signal, and more particularly, to a method, medium, and system encoding and/or decoding a multi-channel audio signal by using spatial cues generated using direction information of a plurality of channels, and a decoding method, medium, and system for outputting a 2-channel signal from a mono signal down-mixed from multi-channels.

2. Description of the Related Art

According to conventional techniques for encoding and/or decoding a multi-channel audio signal, multi-channel audio signals are encoded and/or decoded based on that fact that a spatial effect that can be felt by a person is mainly caused by binaural influences, resulting in the positions of specific sound sources being recognizable by using interaural level differences (ILD) and interaural time differences (ITD) of sounds arriving at the respective ears of the person. Thus, according to the conventional techniques, when a multi-channel audio signal is encoded, the multi-channel audio signal is generally down-mixed to a mono signal, and information regarding the encoded/down-mixed channels is expressed by spatial cues of an inter-channel level differences (ICLDs) and inter-channel time differences (ICTDs). Thereafter, the down-mixed/encoded multi-channel audio signal can be decoded using the spatial cues of the ICLDs and ICTDs. Here, the term down-mixed corresponds to a staged mixing of separate input multi-channel signals during encoding, where separate input channel signals are mixed to generate a single down-mixed signal, for example. Through the staging of such down-mixing modules all multi-channel signals may be down-mixed to such a single mono signal. Similarly, such a down-mixed mono signal can be decoded through a staging of up-mixing modules to perform a series of up-mixing of signals until all multi-channel signals are decoded. Here, respective ICLDs and ICTDs generated during each down-mixing in the encoder, through a tree structure of down-mixing modules, can be used by a decoder in a similar mirroring of up-mixing modules to un-mix the down-mixed mono signal.

However, in such an implementation of ICLDs, recognition of the position of a sound source using a ICLD is possible only in a high frequency region where the wavelength of sound is less than the diameter of the head of a listener, resulting in accuracy being degraded in regions of low frequencies. Conversely, in the case of the ICTDs, recognition of the position of a sound source is possible only in a low frequency region where the wavelength of sound is greater than the diameter of the head of the listener, resulting in accuracy being degraded in regions of higher frequencies. Thus, if any, position recognition is frequency dependent.

Meanwhile, in such techniques, in order to further generate a 2-channel virtual stereo sound from the down-mixed mono signal, the mono signal is restored to the multi-channel signals by using the ICLD and ICTD spatial cues, and then the restored multi-channel signals are synthesized into to 2 channels based on head related transfer functions (HRTFs). A HRTF expresses an acoustic process in which sound from a sound source localized in a free space is transferred to the ears of a listener, and includes important information with which the listener determines the position of a sound source. Thus, the HRTFs include much information indicating the characteristics of the space through which sound is transferred, as well as information on the ICTDs, ICLDs, and shapes of earlobes, for example.

In order to synthesize the multi-channel signal into the 2-channel signal using the HRTFs, respective HRTFs corresponding the left ear and the right ear for each channel of the multi-channels are required, resulting in the number of required HRTFs being double the number of the multi-channels. For example, in order to output a 2-channel signal from a 5.1-channel signal, a total of 10 HRTFs are required. HRTFs are conventionally stored in an HRTF database in a decoding system. Accordingly, in order to store many HRTFs in such a database large storage capacities for the database are required.

SUMMARY

One or more embodiments of the present invention provides a method, medium, and system for accurately encoding and/or decoding a multi-channel audio signal irrespective of a frequency region.

One or more embodiments of the present invention also provides a method, medium, and system decoding a down-mixed mono signal to a 2-channel signal, such that the corresponding HRTF database can be reduced in size.

Additional aspects and/or advantages of the invention will be set forth in part in the description which follows and, in part, will be apparent from the description, or may be learned by practice of the invention.

To achieve the above and/or other aspects and advantages, embodiments of the present invention include a method of decoding multi-channel audio signals, including obtaining spatial cues at least indicating frequency independent directivity information for a virtual sound source generated from at least two sound sources among sound sources for a plurality of channels, and a down-mixed signal representing an encoding of the multi-channel audio signals, and restoring the down-mixed signal to the plurality of channel signals by using the spatial cues.

To achieve the above and/or other aspects and advantages, embodiments of the present invention include a method of encoding a multi-channel audio signal, including generating spatial cues at least indicating frequency independent directivity information for a virtual sound source generated from at least two sound sources among sound sources for a plurality of channels, down-mixing a plurality of channel signals to a down-mixed signal through at least one operation of the generating of the spatial cues for at least one generation of a respective virtual sound source, and outputting the down-mixed signal and generated spatial cues.

To achieve the above and/or other aspects and advantages, embodiments of the present invention include a method of decoding a down-mixed signal to a 2-channel signal, the method including restoring the down-mixed signal to a plurality of channel signals by using spatial cues at least indicating frequency independent directivity information of at least one virtual sound source generated from at least two sound sources among sound sources for a plurality of channels, and localizing each of the plurality of channel signals to corresponding positions of respective channels based on a select 2-channel signal, and mixing the localized plurality of channel signals to generate the select 2-channel signal.

To achieve the above and/or other aspects and advantages, embodiments of the present invention include a system decoding a multi-channel audio signal, including a first decoder to decode a first virtual sound source into a first two sound sources among sound sources for a plurality of channels by using a first spatial cue, and a second decoder to decode a second virtual sound source into a second two sound sources, other than the first two sound sources, among the sound sources for the plurality of channels by using a second spatial cue, wherein the first spatial cue indicates frequency independent directivity information for the first virtual sound source, and the second spatial cue indicates frequency independent directivity information for the second virtual sound source.

To achieve the above and/or other aspects and advantages, embodiments of the present invention include a system encoding a multi-channel audio signal including a first encoder to generate a first spatial cue indicating frequency independent directivity information of a first virtual sound source generated from a first two sound sources among sound sources for a plurality of channels, and to calculate the directivity information of the first virtual sound source by using the first spatial cue and respective directivity information of the first two sound sources, and a second encoder to generate a second spatial cue indicating frequency independent directivity information of a second virtual sound source generated from a second two sound sources, other than the first two sound sources, among the sound sources for the plurality of channels, and to calculates the directivity information of the second virtual sound source by using the second spatial cue and respective directivity information of the second two sound sources.

To achieve the above and/or other aspects and advantages, embodiments of the present invention include a system decoding a down-mixed signal, down-mixed from a plurality of channel signals to a 2-channel signal, the system including a decoding unit to restore the down-mixed signal to the plurality of channel signals by using spatial cues at least indicating frequency independent directivity information of at least one virtual sound source generated from at least two sound sources among sound sources for a plurality of channels, an HRTF generation unit to generate HRTFs corresponding to a channel other than a predetermined channel among the plurality of channels based on a predetermined HRTF corresponding to the predetermined channel and the spatial cues, and a 2-channel-synthesis unit to localize the plurality of channel signals to corresponding positions of respective channels based on a select 2-channel signal by using the predetermined HRTF corresponding to the predetermined channel and the generated HRTFs, and mixing the localized plurality of channel signals to generate the select 2-channel signal.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
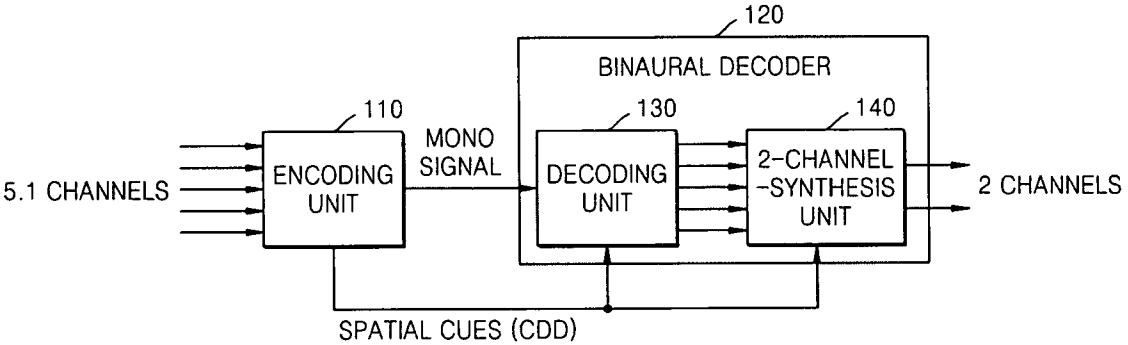
FIG. 1 illustrates a system to encode a multi-channel signal into a down-mixed mono signal and the generation of decoded 2 channels from an up-mixing of the down-mixed mono signal, according to an embodiment of the present invention.

Reference will now be made in detail to embodiments of the present invention, examples of which are illustrated in the accompanying drawings, wherein like reference numerals refer to the like elements throughout. Embodiments are described below to explain the present invention by referring to the figures.

FIG. 1 illustrates an end-to-end system showing an encoding of multi-channel signals into a down-mixed mono signal, and the generation of decoded 2 channels from an up-mixing of the down-mixed mono signal, according to an embodiment of the present invention.

The system may include a binaural decoder 120 including a decoding unit 130 and a 2-channel-synthesis unit 140, for example.

First, a plurality of channel signals may be input to the encoding unit 110, as the multi-channel signals. Referring to FIG. 1, an example of the plurality of channel signals, in a 5.1 channel system, may include a front center (C) channel, a front right (Rf) channel, a front left (Lf) channel, a rear right (Rs) channel, a rear left (Ls) channel, and a low frequency effect (LFE) channel, noting that embodiments of the present invention are not limited to the same, e.g., embodiments of the present invention may also be applied to a 7.1 channel system, only as an example.

Thus, the encoding unit 110 may generate spatial cues indicating frequency independent direction information of a virtual sound source generated by at least two channel sound sources among the sound sources of the plurality of channels, during the down-mixing of the plurality of channel signals to eventually generate the resultant down-mixed mono signal.

Below, for convenience of explanation, such spatial cues will also be referred to as channel directivity differences (CDDs), noting that alternative spatial cues with direction information may be available.

Thus, according to an embodiment of the present invention, the binaural decoder 120 may receive an input of such CDD spatial cues and the down-mixed mono signal, and by using the CDD spatial cues, up-mix the down-mixed mono signal to the multi-channel signals, and then further up-mix each multi-channel signal to synthesize a 2-channel signal.

Thus, here, the decoding unit 130 may receive the CDD spatial cues and the down-mixed mono signal, and by using the CDD spatial cues, restore a plurality of channel signals as the up-mixed multi-channel signals.

In an embodiment, and as noted above, in addition to the up-mixing of the multi-channel signals, the 2-channel-synthesis unit 140 may localize the up-mixed multi-channel signals, according to the positions of the respective channels, by using the CDD spatial cues and corresponding head related transfer functions (HRTFs), and thus, generate the 2-channel signal.

Figure 2A:
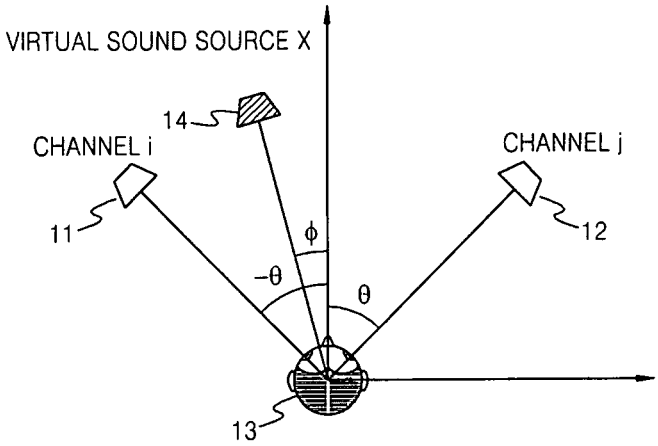
FIG. 2A illustrates a method of generating spatial cues indicating directivity information of virtual sound sources generated for a plurality of channels, according to an embodiment of the present invention.

According to only an example, FIG. 2A illustrates a method of generating CDD spatial cues indicating directivity information of virtual sound sources generated by at least 2 channel sound sources among a plurality of channels, according to an embodiment of the present invention. According to one embodiment, such generation of the CDD spatial cues is performed during the down-mixing of input multi-channel signals by the encoder, with such CDD spatial cues being forwarded to the decoder for use in the decoding of the down-mixed mono signal.

Referring to FIG. 2A, as only convenience for explanation, only channel i 11 and channel j 12 are illustrated, noting that other channels (not shown) may also be distributed about the illustrated listener 13.

As illustrated, when a multi-channel audio signal is encoded, different magnitudes of energy of respective channels (channel i 11, channel j 12, and other channels) are distributed at a given point in time. In this case, assuming that other channels, other than channels 1 11 and j 12, are not considered and a virtual sound source x 14 is generated only by the sound source of channel i 11 and the sound source of channel j 12, the energy of the virtual sound source x 14 can be considered to be the sum of the energy of channel i 11 and the energy of channel j 12, as in the below Equation 1.

$$W_i^2+W_j^2=W_x^2 \qquad \text{Equation 1}$$

Here, Wi2 is the energy of channel i, Wj2 is the energy of channel j, and Wx2 is the energy of channel x.

If both sides of Equation 1 are divided by Wx2, the result is the below Equation 2.

$$CDD_{xi}^2+CDD_{xj}^2=1 \qquad \text{Equation 2}$$

Here, $CDD_{xi}=W_i^2/W_x^2$, and $CDD_{xj}=W_j^2/W_x^2$.

Meanwhile, relationships of $CDD_{xi}$, $CDD_{xj}$, and directivity information of channel i 21, channel j 22, and virtual sound source x 24 may be represented by the below Equation 3.

Equation 3:

$$\frac{\tan\phi}{\tan\theta}=\frac{CDD_{xi}-CDD_{xj}}{CDD_{xi}+CDD_{xj}}$$

Here, θ represents directivity information of a channel and the angle between each channel and a plane bisecting the channel and a neighboring channel. Since the channel layout may have already been determined when a multi-channel audio signal is encoded, the directivity information of the channel may also be a predetermined value. Further, ϕ represents directivity information of a virtual sound source, and the angle between the virtual sound source x 14 and the bisecting plane, for example. As can be observed from Equation 3, CDDxi and CDDxj indicate the directivity information of the virtual sound source x 14 formed by the two channels i 11 and j 12.

Thus, in a process of generating a CDD, according to an embodiment of the present invention, the energy Wx2 of the virtual sound source x 14, CDDxi, and CDDxj may be obtained through Equations 1 and 2, and the directivity information of the virtual sound source x 14 may be obtained through Equation 3.

Here, based on the illustrated technique shown in FIG. 2A, each or either of channel i 11 and channel j 12 could also be virtual sound sources. For example, assuming that a virtual sound source y (not shown) is generated from two channels, e.g., other than channels i 11 and j 12, then, another virtual sound source z (not shown) may be generated from the generated virtual sound source x 14 and the generated virtual sound source y. In this case, CDDzx and CDDzy may be obtained along with energy and directivity information ϕ of the virtual sound sources.

Figure 2B:
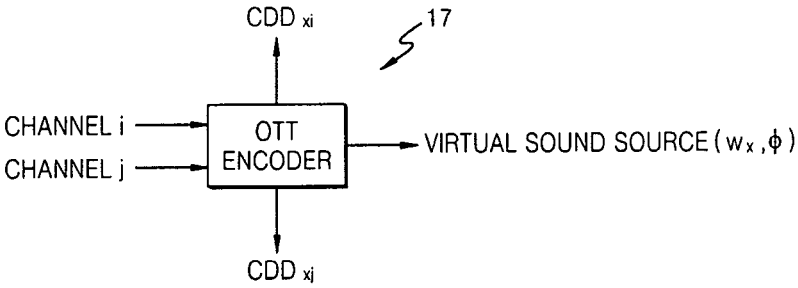
FIG. 2B illustrates a one-to-two (OTT) encoder having inputs of 2 channels, and outputting channels directivity differences (CDDs) and the energy and direction information of a sound source, according to an embodiment of the present invention.

FIG. 2B illustrates a one-to-two (OTT) encoder, having inputs of two separate channels, outputting CDD spatial cues, the energy of a virtual sound source, and directivity information, according to an embodiment of the present invention. Such OTT encoder modules may be repeatedly used for performing sequenced down-mixing to eventually generate the down-mixed mono signal, for example, noting that, upon each down-mixing, respective CDD spatial cues, energy, and directivity information may also be generated.

Here, referring to FIG. 2B, the OTT encoder 17 may, thus, receive input signals of two channels i and j, and output CDDxi, CDDxj, the energy Wx of a virtual sound source, and directivity information ϕ, for example. In addition, such a generated virtual sound source may also be input to another such OTT encoder 17.

Figure 3A:
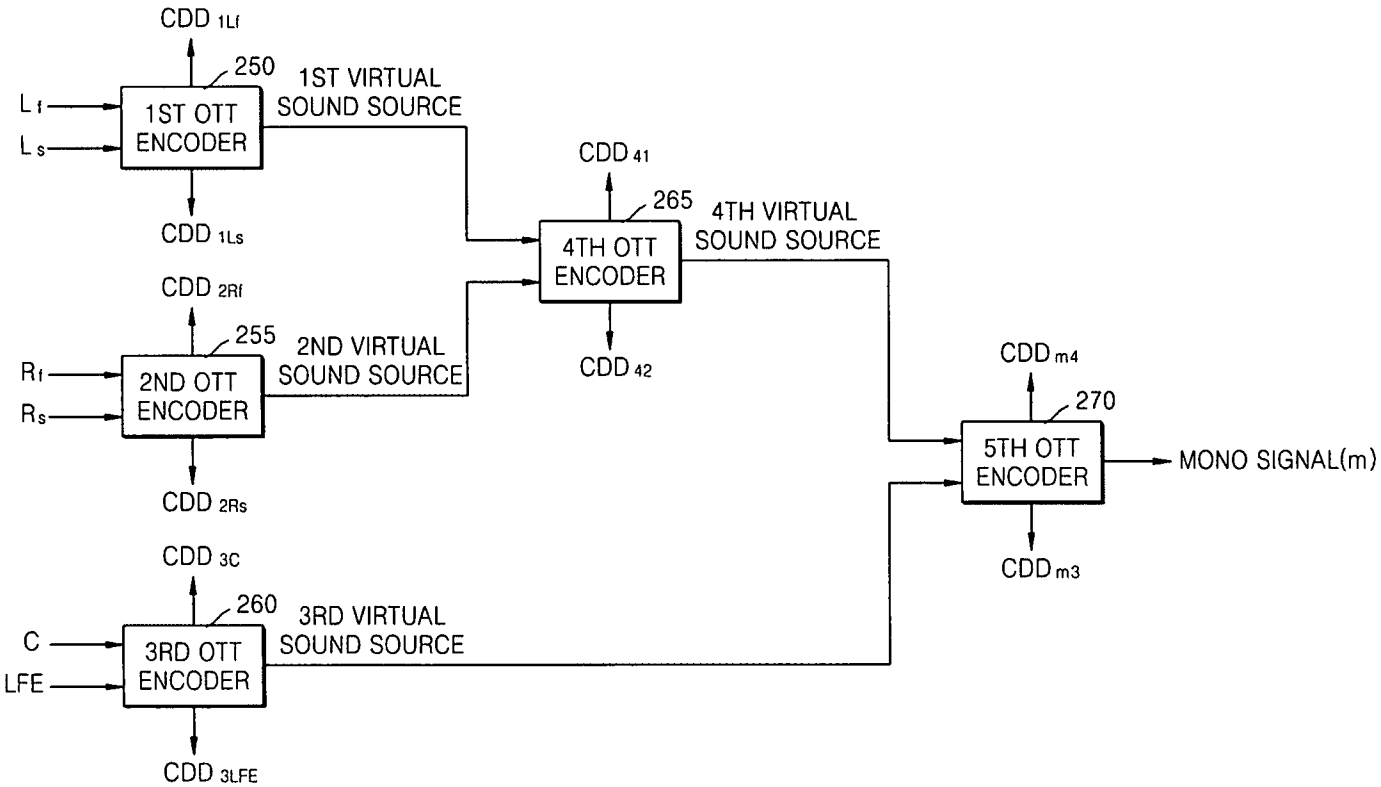
FIG. 3A illustrates a system encoding a multi-channel audio signal by using a 5-1-5 tree structure, according to an embodiment of the present invention.
Figure 3B:
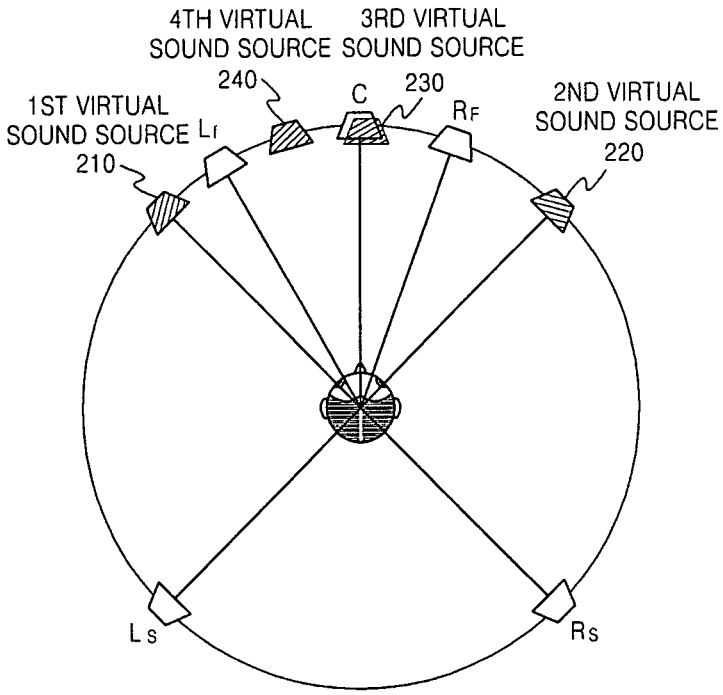
FIG. 3B illustrating a channel layout explaining an encoding method for encoding a multi-channel audio signal, such as with the system illustrated in FIG. 3A, according to an embodiment of the present invention.
Figure 4:
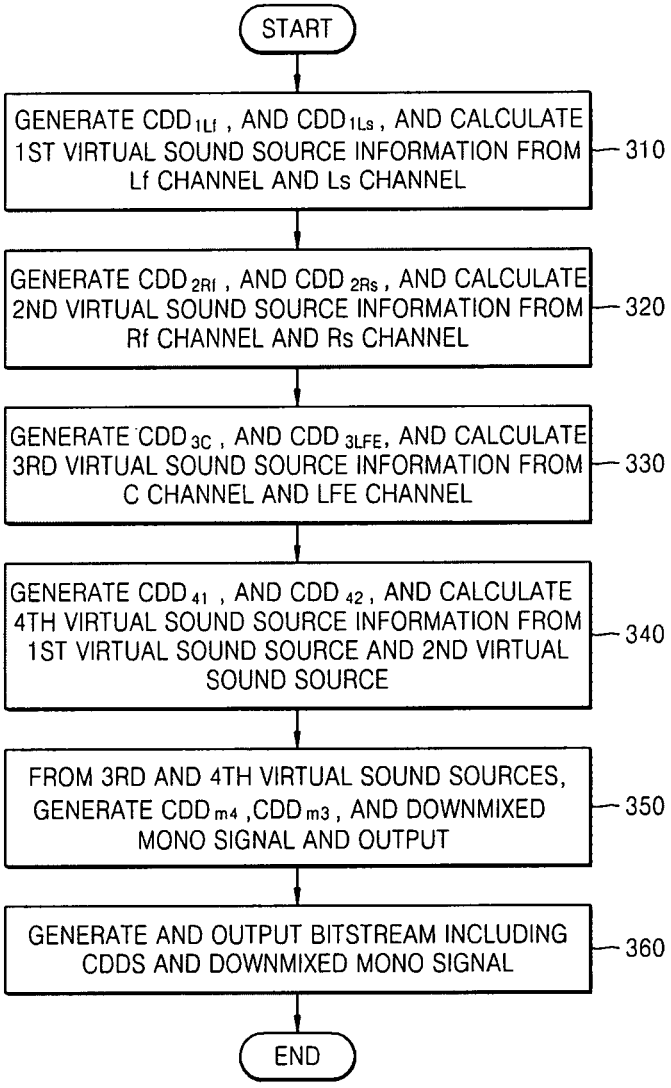
FIG. 4 illustrates a method of encoding 5.1 channels, according to an embodiment of the present invention.

FIG. 3A illustrates a system encoding a multi-channel audio signal by using a 5-1-5 tree structure, according to an embodiment of the present invention, briefly noting that alternative tree structures are equally available. FIG. 3B similarly illustrates a channel layout for explaining an encoding method for encoding a multi-channel audio signal, such as with the system illustrated in FIG. 3A, according to an embodiment of the present invention. FIG. 4 further illustrates a method of encoding 5.1 channels, according to an embodiment of the present invention. Such a method will now be explained with reference to FIGS. 3A and 3B, noting that such references should not be limited to the same. Such methods should also not be construed as being dependent on the referenced tree structure of FIG. 3A nor the illustrated directional channel layout of FIG. 3B.

In operation 310, a first OTT encoder 250 may receive inputs of the Lf channel and the Ls channel, e.g., corresponding to a plurality of available channel signals with determined direction information, generate CDD1Lf and CDD1Ls, and calculate the energy and directivity information of a first virtual sound source 210, as shown in FIG. 3B. In CDD1Lf, and CDD1Ls, the subscript 1 represents the virtual sound source, and Lf and Ls represent the front left channel (Lf) and rear left (Ls) channel, respectively. More specifically, by using the energies of the Lf channel and the Ls channel, the energy of the first virtual sound 210 and spatial cues CDD1Lf and CDD1Ls may be generated, and by using CDD1Lf, CDD1Ls, and directivity information of Lf and Ls channels, the directivity information of the first virtual sound source 210 may, thus, be calculated.

In operation 320, a second OTT encoder 255 may receive inputs of the Rf channel and the Rs channel, generate CDD2Rf and CDD2Rs, and calculate the energy and directivity information of a second virtual sound source 220.

In operation 330, a third OTT encoder 260 may receive inputs of the C channel and the LFE channel, generates CDD3C and CDD3LFE, and calculate the energy and directivity information of a third virtual sound source 230.

Further, in operation 340, a fourth OTT encoder 265 may receive inputs of the first virtual sound source 210 and the second virtual sound source 220, for example. Here, referring back to FIGS. 2A and 2B, operation 340 may be considered as corresponding to the case where the channel i 11 and the channel j 12 are replaced by the first virtual sound source 210 and the second virtual sound source 220, respectively. In operation 340, by using the energies of the first virtual sound source 210 and the second virtual sound source 220, the energy of a fourth virtual sound source 240 and CDD41 and CDD42 may be generated, and by using CDD41, CDD42, and the directivity information of the first virtual sound source 210 and the second sound source 220, the directivity information of the fourth virtual sound source 240 may be calculated.

In operation 350, a fifth OTT encoder 270 may receive inputs of the third virtual sound source 230 and the fourth virtual sound source 240, generate CDDm4 and CDDm3, and output a corresponding down-mixed mono signal, i.e., down-mixed from 5.1-channel signals. In such a method of encoding 5.1 channels, according to this embodiment of the present invention illustrated in FIG. 4, 5.1-channel signals can be down-mixed through operations 310 through 350, again noting that the reference to such a 5.1 channel system is only an example.

In operation 360, a multiplexing unit (not shown) generates and outputs a bitstream, including CDDs and the down-mixed mono signal.

Figure 5:
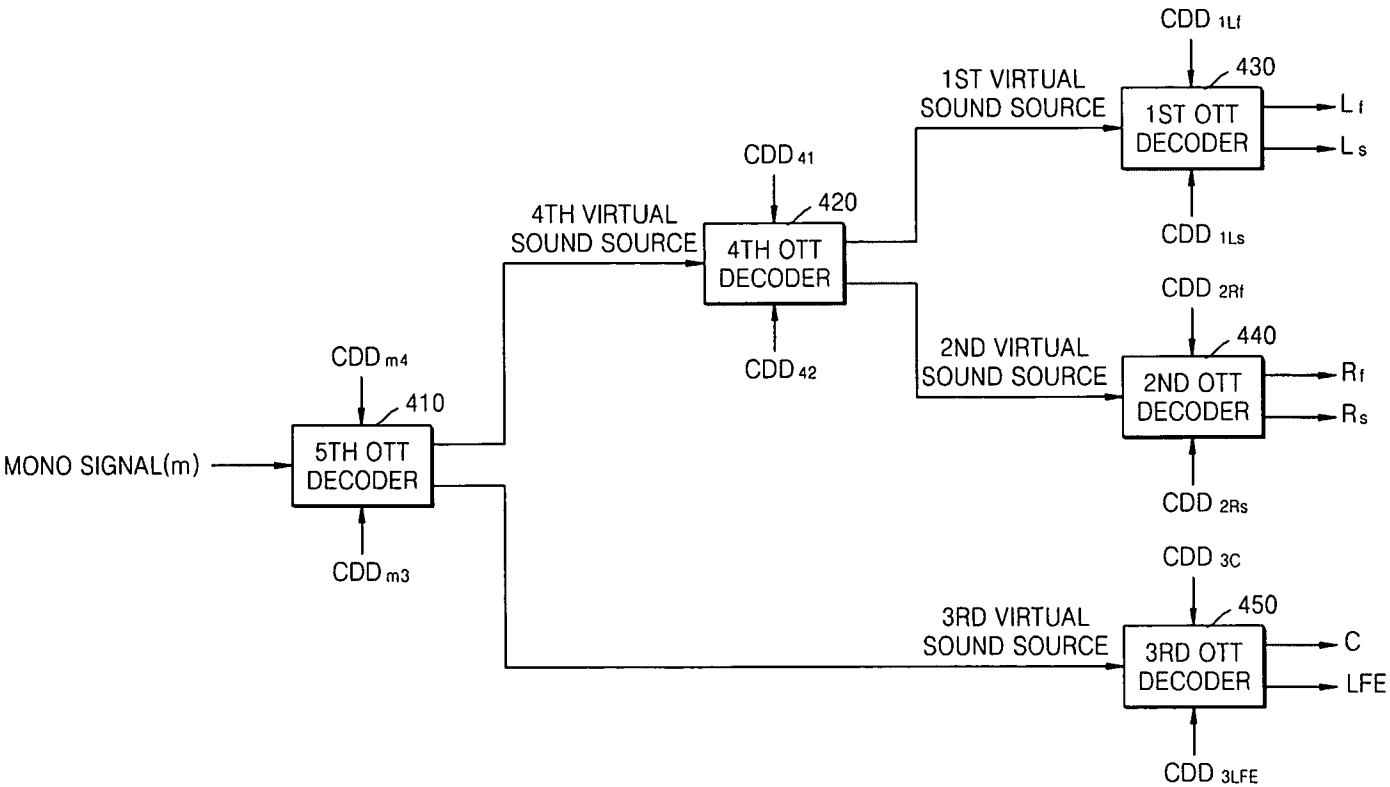
FIG. 5 illustrates a system for decoding a multi-channel audio signal by using a 5-1-5 tree structure, according to an embodiment of the present invention.
Figure 6:
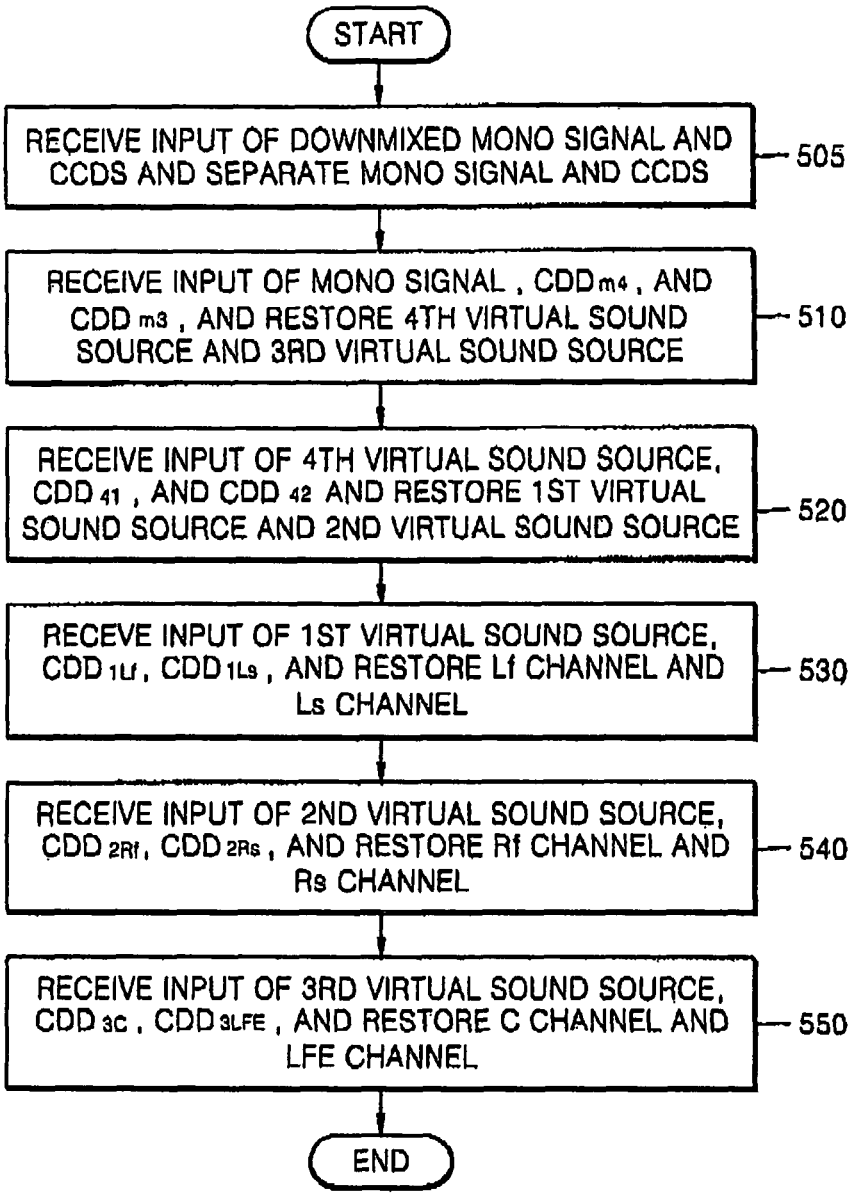
FIG. 6 illustrates a method of decoding a mono signal down-mixed from 5.1 channels, according to an embodiment of the present invention.

FIG. 5 illustrates a system decoding a multi-channel audio signal by using a 5-1-5 tree structure, according to an embodiment of the present invention. Similarly, FIG. 6 illustrates a method of decoding a down-mixed mono signal, e.g., down-mixed from 5.1 channels, according to an embodiment of the present invention, and will now be explained with reference to FIG. 5, noting that such references should not be limited to the same. Such methods should also not be construed as being dependent on the referenced tree structure of FIG. 5.

In operation 505, a demultiplexing unit (not shown) may receive an input of an audio bitstream, including a down-mixed mono signal for multi-channel signals and CDDs, and may proceed to separate/parse the bitstream for the down-mixed mono signal and the CDDs.

In operation 510, a fifth OTT decoder 410 may restore the down-mixed mono signal to a down-mixed third virtual sound source and a down-mixed fourth virtual sound source, by using CDDm4 and CDDm3, for example In operation 520, a fourth OTT decoder 420 may further restore the down-mixed fourth virtual sound source to a down-mixed first virtual sound source and a down-mixed second virtual sound source, by using CDD41 and CDD42, for example In operation 530, a first OTT decoder 430 may restore the down-mixed first virtual sound source to an Lf channel and an Ls channel, by using CDDiLf and CDD1Ls, for example In operation 540, a second OTT Decoder 440 may restore the down-mixed second virtual sound source to an Rf channel and an Rs channel, by using CDD2Rf and CDD2Rs, for example In operation 550, a third OTT decoder 450 may restore the down-mixed third virtual sound source to a C channel and an LFE channel, by using CDD3C and CDD3LFE, again as examples.

Here, the Lf, Ls, Rf, Rs, C, and LFE channel signals, output by such a system for decoding a multi-channel audio signal illustrated in FIG. 5, may be represented by the below Equations 4 through 9.

$$Lf=CDD_{m4}CDD_{41}CDD_{1Lf}m \quad \text{Equation 4}$$

$$Ls=CDD_{m4}CDD_{41}CDD_{1ILs}m \quad \text{Equation 5}$$

$$Rf=CDD_{m4}CDD_{42}CDD_{2Rf}m \quad \text{Equation 6}$$

$$Rs=CDD_{m4}CDD_{42}CDD_{2Rs}m \quad \text{Equation 7}$$

$$C=CDD_{m3}CDD_{3c}m \quad \text{Equation 8}$$

$$LFE=CDD_{m3}CDD_{3LFE}m \quad \text{Equation 9}$$

Figure 7:
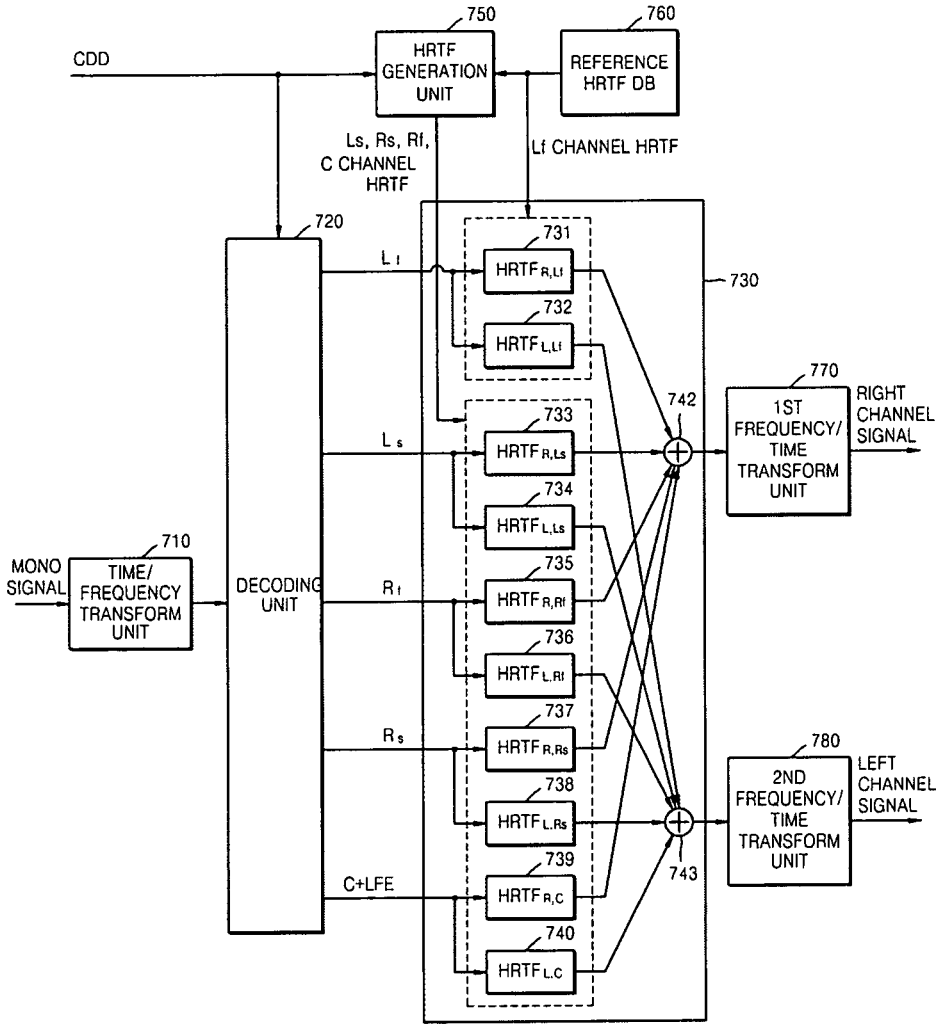
FIG. 7 illustrates a decoding system outputting a 2-channels signal from a mono signal down-mixed from a plurality of channels, according to an embodiment of the present invention.

FIG. 7 illustrates a decoding system to generate a 2-channels signal from a down-mixed mono signal for multi-channel signals, according to an embodiment of the present invention.

Referring to FIG. 7, as an example of such multi-channel signals, e.g., in a 5.1 channel system, such channel signals may include C, Rf, Lf, Rs, Ls, and LFE channels. Here, it is again noted that embodiments of the present invention are not limited to such a system, e.g., embodiments of the present invention may be applicable to a 7.1 channel system.

Referring to FIG. 7, the decoding system may include of a time/frequency transform unit 710, a decoding unit 720, a 2-channel-synthesis unit 730, an HRTF generation unit 750, a reference HRTF DB 760, a first frequency/time transform unit 770, and a second frequency/time transform unit 780, for example.

Here, the 2-channel-synthesis unit 730 may further include sound localization units 731 through 740, a right channel mixing unit 742, and a left channel mixing unit 743, for example.

The time/frequency transform unit 710 may receive an input of the down-mixed mono signal for multi-channel signals, transform the mono signal into the frequency domain, and output the same as a respective frequency domain signal.

The decoding unit 720 may receive respective CDD spatial cues indicating directivity information of the respective virtual sound sources, e.g., generated by at least two channel sound sources among the sound sources of the multi-channels, and the frequency domain down-mixed mono signal, and restore the frequency domain down-mixed mono signal to Lf, Ls, Rf, Rs, C and LFE channel signals, by using the CDD spatial cues.

In FIG. 7, the HRTF DB 760 may store a set of HRTFs corresponding to any one channel, for example, of the Lf, Ls, Rf, Rs, and C channels, also as an example. Hereinafter, the HRTF stored in the HRTF DB 760 will be referred to as the reference HRTF. In FIG. 7, the HRTF DB 760, thus, may store a set of HRTFs corresponding to the Lf channel, and in an example case, a right HRTF (HRTFR,Lf) and a left HRTF (HRTFL,Lf).

The HRTF generation unit 750 may further receive the CDD spatial cues and HRTFs stored in the HRTF DB 760, and by using the CDD spatial cues and the HRTFs, generate HRTFs corresponding to other channels, i.e., Ls, Rf, Rs, and C channels, for example.

The HRTF generation unit 750 will now be explained in greater detail with reference to the aforementioned Equations 4 through 9. As can be observed from Equations 4 through 9, each channel signal output from the decoding unit 720 may be in a form in which the down-mixed mono signal m is multiplied by respective CDD spatial cues.

In an embodiment, the HRTF generation unit 750 may assign a weighting to a reference HRTF, with the weighting being a ratio of the product of CDD spatial cues corresponding to the channel of the reference HRTF, to the product of CDD spatial cues corresponding to the channel of an HRTF desired to be generated, among the products multiplied to the down-mixed mono signal in Equations 4 through 9. Thus, the HRTF generation unit 750 may generate the HRTF corresponding to the another channel other than the reference HRTF. That is, by convoluting the ratio of the products of the CDD spatial cues and the reference HRTF, a HRTF corresponding to the other channel, other than the reference HRTF, may be generated.

For example, in Equation 4, the Lf channel signal, corresponding to the reference HRTF, may be in a form in which the down-mixed mono signal m is multiplied by CDDm4CDD41CDD1Lf. Meanwhile, in Equation 7, the Rs channel signal may be in a form in which the down-mixed mono signal m is multiplied by CDDm4CDD42CDD2Rs. In this case, the HRTF corresponding to the Rs channel may thus be generated by assigning a weight of $$\frac{CDD_{m4}CDD_{42}CDD_{2Rs}}{CDD_{m4}CDD_{41}CDD_{1Lf}},$$

to the HRTF of the Lf channel, which is the reference HRTF.

The 2-channel-synthesis unit 730 may, thus, receive an input of an HRTF corresponding to each channel from the reference HRTF DB 760 and the HRTF generation unit 750, for example.

In an embodiment, the sound localization units 731 through 740, included in the 2-channel-synthesis unit 730, may further localize channel signals to the positions of the respective channels, by using a respective HRTF, and generate the localized channel signals. Since the reference HRTF is that of the Lf channel in FIG. 7, the Lf channel sound localization units 731 and 732 may receive the HRTF from the reference HRTF DB 760, and the sound localization units 733 through 740, for channels other than the Lf channel, may receive inputs of HRTFs from the HRTF generation unit 750.

As illustrated, the right channel mixing unit 742 may then mix signals output from the right channel sound localization units 731, 733, 735, 737, and 739, and the left channel mixing unit 743 may mix signals output from the left channel sound localization units 732, 734, 736, 738, and 740.

The first frequency/time transform unit 770 may further receive an input of the signal mixed in the right channel mixing unit 742, transform the signal to a time domain signal, and output the right channel signal, thereby achieving a synthesizing of the right channel signal.

Similarly, the second frequency/time transform unit 780 may receive an input of the signal mixed in the left channel mixing unit 743, transform the signal to a time domain signal, and output the left channel signal, again thereby achieving a synthesizing of the left channel signal.

Figure 8:
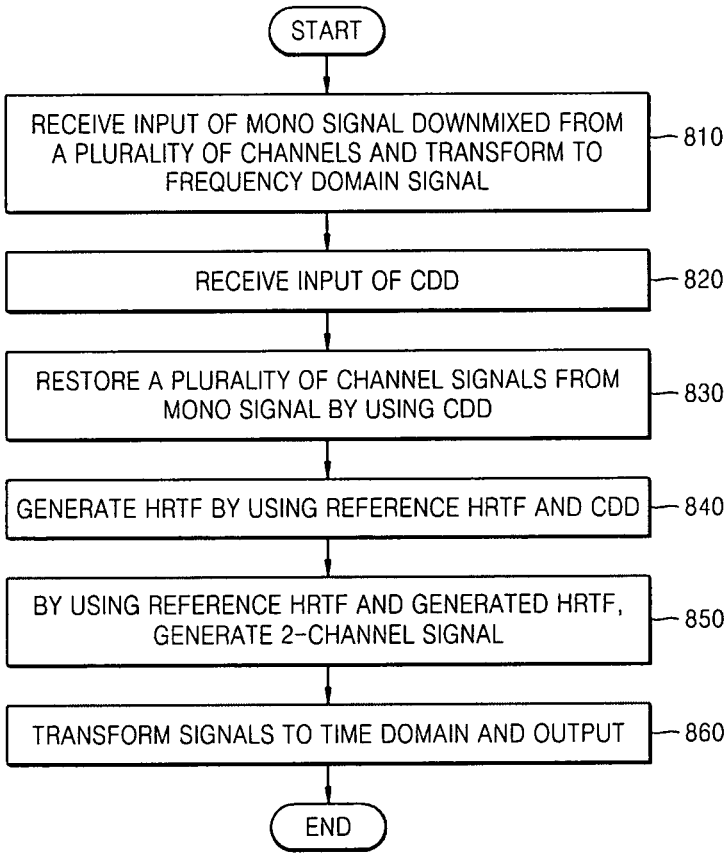
FIG. 8 illustrates a decoding method of outputting a 2-channel signal from a mono signal down-mixed from a plurality of channels, according to an embodiment of the present invention.

FIG. 8 illustrates a decoding method for generating a 2-channel signal from a down-mixed mono signal for multi-channel, according to an embodiment of the present invention. In one embodiment, the decoding method may be performed in a time series in a decoding system, such as that illustrated in FIG. 7. Here, though the decoding system of FIG. 7 may be referenced below as an example of the operations of FIG. 8, embodiments of the present invention should not be limited to the same. In addition, embodiments of the present invention may further include features represented/performed by the elements shown in FIG. 7, even is not particularly referenced below.

In operation 810, as an example, the time/frequency transform unit 710 may receive a down-mixed mono signal for multi-channels, and transform the down-mixed mono signal to a respective frequency domain signal.

In operation 820, the decoding unit 720 and the HRTF generation unit 750, for example, may receive CDD spatial cues indicating directivity information of a virtual sound source generated by at least two channel sound sources, among sound sources for the multi-channels.

In operation 830, the decoding unit 720, for example, may restore the frequency domain down-mixed mono signal to respective multi-channel signals, by using the CDD spatial cues.

In operation 840, the HRTF generation unit 750 may receive an HRTF corresponding to a predetermined channel, among the multi-channels, e.g., from the reference HRTF DB 760, and by using the input HRTF and the CDD spatial cues, the HRTF generation unit 750 may generate an HRTF corresponding to a channel other than the predetermined channel.

In operation 850, the 2-channel-synthesis unit 730 may then localize the decoded multi-channel signals to respective positions, by using the HRTF corresponding to the predetermined channel and the generated HRTFs, thereby generating a 2-channel signal.

In operation 860, the first frequency/time transform unit 770 and the second frequency/time transform unit 780 may transform the 2-channel signal to time domain signals.

Thus, according to an embodiment of the present invention, information spatial cues indicating the directivity information of virtual sound sources may be generated for multi-channels and a corresponding down-mixed mono multi-channel audio signal may be encoded and/or decoded.

Since such directivity information of virtual sound sources is determined according to information of channel layouts and is not dependent on frequencies of the channel signals, a multi-channel audio signal can be accurately encoded and/or decoded irrespective frequency regions.

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including magnetic storage media (e.g., ROM, floppy disks, hard disks, etc.), optical recording media (e.g., CD-ROMs, or DVDs), and storage/transmission media such as carrier waves, as well as through the Internet, for example. Here, the medium may further be a signal, such as a resultant signal or bitstream, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of decoding a plurality of channel signals, comprising:

receiving a mono signal obtained from down-mixing the plurality of channel signals;

obtaining spatial cues, the spatial cues being generated based on an enemy of each sound source corresponding to the plurality of channel signals and an enemy of each virtual sound source generated by an encoder during the down-mixing of the plurality of channel signals; and restoring the mono signal to the plurality of channel signals by using the spatial cues.

2. The method of claim 1, wherein the spatial cues comprise frequency independent directivity information for the virtual sound source.

3. The method of claim 1, wherein the directivity information for the virtual sound source is directivity information calculated by using corresponding spatial cues and respective directivity information for each of two sound sources among the sound sources.

4. The method of claim 1, wherein the restoring of the mono signal to the plurality of channel signals by using the spatial cues comprises:

restoring the mono signal to a first virtual sound source and a second virtual sound source by using corresponding spatial cues; and restoring the first virtual sound source to a third virtual sound source and a fourth virtual sound source by using other corresponding spatial cues.

5. The method of claim 4, wherein the restoring of the mono signal to the plurality of channel signals by using the spatial cues further comprises restoring at least one of the first virtual sound source, second virtual sound sources, third virtual sound sources, and fourth virtual sound sources selectively to two channel signals among the plurality of channel signals by using additional corresponding spatial cues.

6. The method of claim 1, wherein in the obtaining of the spatial cues and the mono signal, the spatial cues and the mono signal are obtained from a parsing of a received bitstream.

7. The method of claim 1, wherein the sound sources comprise two sound sources corresponding to respective channels of the plurality of channel signals or two virtual sound sources each with directivity information different from directions corresponding to the plurality of channel signals.

8. At least one non-transitory medium comprising computer readable code to control at least one processing element to implement the method of claim 1.

9. A method of encoding a plurality of channel signals, comprising:

generating spatial cues based on an energy of each sound source corresponding to the plurality of channel signals and an energy of each virtual sound source generated during down-mixing of the plurality of channel signals;

down-mixing the plurality of channel signals to a mono signal; and outputting the mono signal and the generated spatial cues.

10. The method of claim 9, wherein, the sound sources comprise two sound sources corresponding to respective channels of the plurality of channel signals or two virtual sound sources each with directivity information different from directions corresponding to the plurality of channel signals.

11. The method of claim 9, wherein the directivity information for the virtual sound source is calculated by using generated spatial cues and respective directivity information for each of the at least two sound sources.

12. The method of claim 9, wherein the generating of the spatial cues further comprises:

generating first spatial cues indicating directivity information of a first virtual sound source generated from predetermined two sound sources, and calculating the directivity information of the first virtual sound source by using the first spatial cues and respective directivity information of each of the predetermined two sound sources; and generating second spatial cues indicating directivity information of a second virtual sound source generated from other predetermined two sound sources, other than the predetermined two sound sources and calculating the directivity information of the second virtual sound source by using the second spatial cues and respective directivity information of each of the other predetermined two sound sources.

13. The method of claim 9, wherein the generating of the spatial cues comprises:

generating a first spatial cue indicating directivity information of a first virtual sound source generated from predetermined two sound sources, and calculating the directivity information of the first virtual sound source by using the first spatial cue and respective directivity information of each of the predetermined two sound sources;

generating a second spatial cue indicating directivity information of a second virtual sound source generated from other predetermined two sound sources, other than the predetermined two sound sources and calculating the directivity information of the second virtual sound source by using the second spatial cue and respective directivity information of each of the other predetermined two sound sources; and generating a third spatial cue indicating directivity information of a third virtual sound source generated from the first and second virtual sound sources, and generating the directivity information of the third virtual sound source by using the third spatial cue and the directivity information of the first virtual sound source and the directivity information of the second virtual sound source.

14. The method of claim 9, wherein in the outputting of the mono signal and the generated spatial cues, the mono signal and the generated spatial cues are encoded into a bitstream.

15. At least one non-transitory medium comprising computer readable code to control at least one processing element to implement the method of claim 9.

16. The method of claim 9, wherein, in the generating of the spatial cues for the virtual sound source generated from the at least two sound sources, a first spatial cue is generated using a ratio of a first energy of a first sound source and an energy of the virtual sound source, and a second spatial cue is generated using a ratio of a second energy of a second sound source and the energy of the virtual sound source.

17. A method of decoding a down-mixed signal to a 2-channel signal, the method comprising:

restoring the down-mixed signal to a plurality of channel signals by using spatial cues being generated based on an energy of each sound source corresponding to the plurality of channel signals and an energy of each virtual sound source generated by an encoder during down-mixing of the plurality of channel signals;

generating respective head related transfer functions (HRTFs) which are applied to the plurality of channels by assigning a weight to a reference HRTF; and localizing the plurality of channel signals to corresponding positions of respective channels based on a select 2-channel signal, and mixing the localized plurality of channel signals to generate the select 2-channel signal, wherein, in the localizing of each of the plurality of channel signals, localizing is performed by applying the respective HRTFs.

18. The method of claim 17, further comprising generating select respective HRTFs corresponding to a channel other than a predetermined channel among the plurality of channels, by using a predetermined channel HRTF corresponding to the predetermined channel and respective spatial cues, wherein, when localizing a restored channel signal corresponding to the predetermined channel, the localizing is performed by using the predetermined HRTF corresponding to the predetermined channel.

19. The method of claim 18, wherein, in the generating of the respective HRTFs, spatial cues and the predetermined channel HRTF are convoluted to generate the respective HRTFs corresponding to the channel other than the predetermined channel.

20. The method of claim 18, wherein the predetermined channel is one of the select 2-channel signal.

21. The method of claim 17, further comprising:

transforming the down-mixed signal into a frequency domain signal; and transforming the select 2-channel signal into a time domain signal.

22. At least one medium comprising computer readable code to control at least one processing element to implement the method of claim 17.

23. A system decoding a multi-channel audio signal, comprising:

a first one-to-two (OTT) decoder to decode a first virtual sound source to output a first two sound sources among sound sources for a plurality of channels by using a first spatial cue; and a second OTT decoder to decode a second virtual sound source to output a second two sound sources, other than the first two sound sources, among the sound sources for the plurality of channels by using a second spatial cue, wherein the first spatial cue indicates frequency independent directivity information for the first virtual sound source, and the second spatial cue indicates frequency independent directivity information for the second virtual sound source.

24. A system encoding a multi-channel audio signal comprising:

a first encoder to generate a first spatial cue indicating frequency independent directivity information of a first virtual sound source generated from a first two channels among a plurality of channels, and to calculate the directivity information of the first virtual sound source by using the first spatial cue and respective directivity information of the first two channels;

a second encoder to generate a second spatial cue indicating frequency independent directivity information of a second virtual sound source generated from a second two channels, other than the first two channels, among the plurality of channels, and to calculate the directivity information of the second virtual sound source by using the second spatial cue and respective directivity information of the second two channels; and a third encoder to generate a third spatial cue indicating frequency independent directivity information of a third virtual sound source generated from the first virtual sound source and second virtual sound source which are provided as inputs to the third encoder.

25. A system decoding a down-mixed signal, down-mixed from a plurality of channel signals to a 2-channel signal, the system comprising:

a decoding unit to restore the down-mixed signal to the plurality of channel signals by using spatial cues being generated based on an energy of each sound source corresponding to the plurality of channel signals and an energy of each virtual sound source generated by an encoder during down-mixing of the plurality of channel signals;

a head related transfer function (HRTF) generation unit to generate respective HRTFs which are applied to the plurality of channels by assigning a weight to a reference HRTF; and a 2-channel-synthesis unit to localize the plurality of channel signals to corresponding positions of respective channels based on a select 2-channel signal by using the respective HRTFs, and mixing the localized plurality of channel signals to generate the select 2-channel signal.

* * * * *

UNITED STATES PATENT AND TRADEMARK OFFICE

CERTIFICATE OF CORRECTION

PATENT NO. : 8,867,751 B2
APPLICATION NO. : 11/702077
DATED : October 21, 2014
INVENTOR(S) : Youngtae Kim It is certified that error appears in the above-identified patent and that said Letters Patent is hereby corrected as shown below:

In the Claims

Column 11, Line 17, In Claim 1, delete “enemy” and insert -- energy --, therefor.
Column 11, Line 18, In Claim 1, delete “enemy” and insert -- energy --, therefor.
Column 13, Line 38, In Claim 22, after “one” insert -- non-transitory recording --.

Signed and Sealed this
Eighth Day of September, 2015

Michelle K. Lee

Michelle K. Lee
*Director of the United States Patent and Trademark Office*